US008980068B2

(12) United States Patent
Hayes et al.

(10) Patent No.: US 8,980,068 B2
(45) Date of Patent: Mar. 17, 2015

(54) NICKEL PH ADJUSTMENT METHOD AND APPARATUS

(76) Inventors: Allen R. Hayes, Muskegon, MI (US); Steven L. Swanson, Muskegon, MI (US)

( * ) Notice: Subject to any disclaimer, the term of this patent is extended or adjusted under 35 U.S.C. 154(b) by 1211 days.

(21) Appl. No.: 12/858,887

(22) Filed: Aug. 18, 2010

(65) Prior Publication Data

US 2012/0043214 A1 Feb. 23, 2012

(51) Int. Cl.
*C25D 17/10* (2006.01)
*C25D 21/12* (2006.01)
*C25D 21/18* (2006.01)

(52) U.S. Cl.
CPC ..... *C25D 21/18* (2013.01); *C25D 17/10* (2013.01); *C25D 21/12* (2013.01)
USPC ..... 204/239; 204/241; 204/274; 205/101

(58) Field of Classification Search
CPC ..... C25D 21/12; C25D 21/18; C25D 17/10
USPC ..... 204/232–241, 274
See application file for complete search history.

(56) References Cited

U.S. PATENT DOCUMENTS 4,087,338 A 5/1978 Gendron et al.
4,214,952 A 7/1980 Sato et al.
4,288,305 A 9/1981 Garritsen et al.
4,376,018 A 3/1983 Kohl
4,411,744 A 10/1983 Rosegren et al.
4,416,745 A 11/1983 Warren
H36 H 3/1986 Smith
5,173,170 A 12/1992 Brown et al.
5,282,934 A 2/1994 Cox
5,403,460 A 4/1995 Sala et al.
5,419,821 A 5/1995 Vaughan
5,478,461 A 12/1995 Sala et al.
6,056,862 A 5/2000 Kumagai
6,074,545 A 6/2000 Ginatta
6,607,614 B1 8/2003 Richardson et al.
7,666,283 B2 2/2010 Mobius et al.
2002/0092775 A1 7/2002 Andrews et al.
2006/0226002 A1 10/2006 Mobius et al.
2009/0211918 A1 8/2009 Hardee

*Primary Examiner* — Nicholas A Smith
(74) *Attorney, Agent, or Firm* — Carmody Torrance Sandak & Hennessey LLP

(57) ABSTRACT

An electrolytic cell for adjusting pH and replenishing nickel in a nickel plating solution of a nickel plating bath and a method of using the same is disclosed. The electrolytic cell comprises an inlet for receiving nickel plating solution from the nickel plating bath; a cooled cathode connected to a first bus bar connected to a negative terminal of a power supply; a plurality of nickel anodes capable of creating hydrogen gas on the cooled cathode when current is applied, connected to at least a second bus bar, the at least the second bus bar connected to a positive terminal of the power supply; and an outlet for returning nickel plating solution in the electrolytic cell to the nickel plating bath.

23 Claims, 1 Drawing Sheet

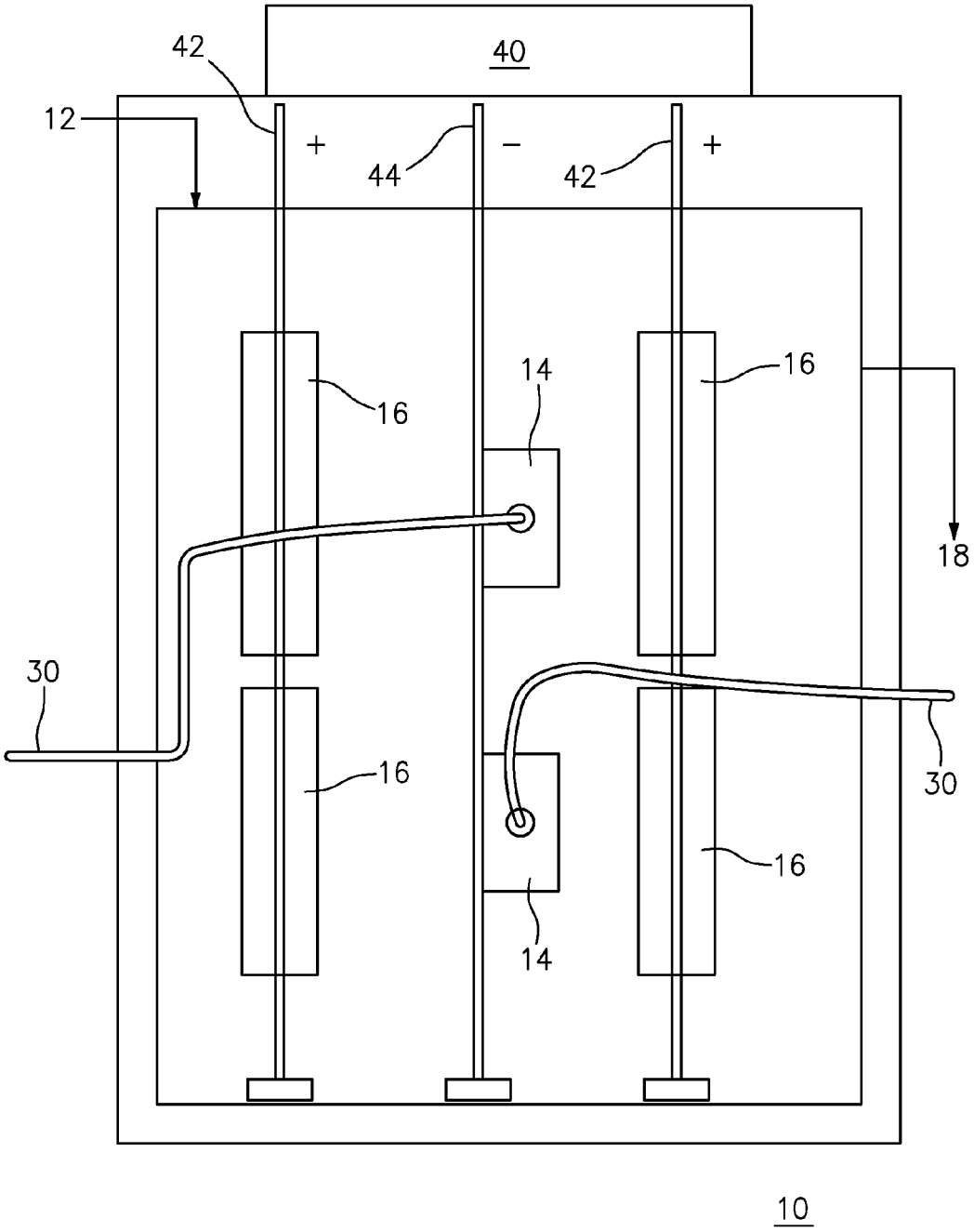
40
42
12
+
44
−
42
+
16
14
16
18
30
16
30
16
14
10

NICKEL PH ADJUSTMENT METHOD AND APPARATUS

FIELD OF THE INVENTION

The present invention relates generally to the adjustment and control of pH in a nickel plating bath.

BACKGROUND OF THE INVENTION

Electroplating is a well known process for applying metal coatings to an electrically conductive substrate. The process employs a bath filled with a metal salt containing electrolyte, at least one metal anode and a source of direct electrical current such as a rectifier. A workpiece to be plated acts as a cathode.

Nickel electroplating involves the deposition of nickel on a part, immersed into an electrolyte solution and used as a cathode, while the nickel anode is being dissolved into the electrolyte in the form of the nickel ions, traveling through the solution and depositing on the cathode surface.

Common nickel plating baths including bright nickel plating baths, semi-bright nickel plating baths, among others. Bright nickel plating baths are used to provide a decorative appearance on a substrate because of their ability to cover imperfections in the base metal (i.e., leveling). Bright nickel plating baths are used in the automotive, electrical, appliance, hardware and other industries where a bright surface is desired. Semi-bright nickel plating baths are used for engineering purposes where brightness is not desired and were developed in part for their ease in polishing.

The most common nickel plating bath is known as a Watts bath and typically contains about 20-40 oz/gal nickel sulfate, 4-12 oz/gal nickel chloride and 4-6 oz/gal boric acid. The Watts bath is typically operated within a pH range of about 2-5 and at a current density of 20-100 asf. Other plating baths include high chloride solutions, all-chloride solutions, fluoroborate solutions and sulfamate solutions, by way of example and not limitation.

Nickel sulfamate plating baths are based on the nickel salt of sulfamic acid and the pH of the bath is adjusted using sulfamic acid, nickel oxide or nickel carbonate. Nickel coatings from this type of bath typically exhibit very low stress values and high elongations. One advantage of this bath is that it can be operated at higher nickel concentrations (e.g., about 180-200 g/l) which allows for the use of high current densities without losing the properties of the coating. Nickel sulfamate baths typically comprise about 40-60 oz/gal nickel sulfamate, 0-4 oz/gal nickel chloride and 4-6 oz/gal boric acid and are operated within a pH range of 3.5-4.5 and a current density of about 5-260 asf. High nickel concentrations of sulfamate electrolytes permit the conduct electroplating at high current densities (high rates of deposition).

Notwithstanding the type of nickel plating bath that is used, it is often necessary to make chemical additions to the nickel plating bath to increase pH and replenish nickel concentration in the bath.

As discussed above, bright and semi-bright nickel plating baths are typically operated at a pH of between 3.5-4.5. The pH typically rises slowly during operation, since the cathode efficiency is slightly lower than the anode efficiency. Nickel carbonate is a preferred pH adjuster because it dissolves easily at a pH below 4.0. In addition, the temperature range of the plating bath is important in terms of physical properties and, along with agitation, aids in keeping the bath components mixed and solubilized. If the temperature is too high, the addition agent consumption is increased, adding to the expense of operating and plating problems. If the temperature is too low, boric acid in the bath may begin to precipitate and the brighteners will not respond efficiently.

In a typical plating operation, a series of metal anodes are hung from one or more anode bus bars while workpieces to be plated are immersed in the plating bath and attached to a cathode bus bar. The negative terminal of a DC power supply is connected to the cathode bus bar while the positive terminal of the power supply is connected to the anode bus bar. The voltage is adjusted at the power supply to provide a current density on the cathodic workpieces which is considered optimal.

Most nickel plating processes are operated with soluble nickel anode materials. Nickel from the anode is converted into ions which enter the plating solution to replace those discharged at the cathode. In addition, the anode also distributes current to the workpieces to be plated and influences metal distribution. Insoluble anodes, also referred to as inert anodes, do not dissolve during electrolysis because insoluble anodes are comprised of inert material. Typical insoluble anodes include platinized titanium, platinized tantalum platinized niobium, titanium, niobium, stainless steel and other inert materials.

As discussed above, one of the simplest ways to satisfy anode requirements is to suspend nickel bars from hooks placed on an anode bar so that the nickel is immersed in the plating solution. While bars or electrolytic strip may be used as the anode, anode baskets, such as titanium anode baskets, may also be used. The titanium baskets are typically made of titanium mesh strengthened by solid strips of titanium. The mesh facilitates the free flowing of nickel plating solution.

Inert anode plating processes require replenishment of cations in the electrolyte. Thus, the use of inert anodes in electroplated nickel causes the pH of the bath to decrease and the nickel metal concentration to decrease. In response, nickel carbonate and/or lithium carbonate are added to the plating bath to increase the pH. However, these chemicals are expensive and can also be difficult to dissolve. Nickel sulfate and/or nickel chloride may be added to replenish nickel metal in the plating bath. However, the pH adjusting chemicals can be more expensive than nickel metal.

Therefore, it would be desirable to provide a means for increasing pH of the nickel plating bath and replenishing nickel metal in the plating bath that overcomes some of the deficiencies of the prior art.

SUMMARY OF THE INVENTION

It is an object of the present invention to provide an improved means for adjusting the pH of a nickel plating bath.

It is another object of the present invention to provide an improved means of replenishing nickel in a nickel plating bath.

It is still another object of the present invention to provide an electrolytic cell for adjusting the pH and replenishing nickel in a nickel plating solution.

It is still another object of the present invention to provide a method of replenishing a nickel plating bath that does not require the addition of metal salts.

To that end, in a preferred embodiment, the present invention relates generally to an electrolytic cell for adjusting pH and replenishing nickel in a nickel plating solution, the electrolytic cell comprising:

a) an inlet for receiving nickel plating solution from a nickel plating bath;

b) a cooled cathode;

c) a plurality of nickel anodes capable of creating hydrogen gas on the cooled cathode when current is applied; and
d) an outlet for returning nickel plating solution in the electrolytic cell to the nickel plating bath.

In another preferred embodiment, the present invention relates generally to a method of adjusting the pH and nickel content of a nickel plating solution, the method comprising the steps of:

a) diverting a portion of the nickel plating solution from a nickel plating bath to an electrolytic cell, said electrolytic cell comprising a cooled cathode and a plurality of nickel anodes capable of creating hydrogen gas on the cooled cathode when current is applied;
b) applying current to the nickel anode and the cooled cathode for a period of time to increase the pH of the nickel plating solution, wherein the electrolytic cell replenishes nickel by dissolution of the nickel anode; and
c) returning the nickel plating solution in the electrolytic cell to the nickel plating bath.

BRIEF DESCRIPTION OF THE DRAWINGS

For a fuller understanding of the invention, reference is had to the following description taken in connection with the accompanying figures, in which:

FIG. 1 depicts a schematic of an electrolytic cell in accordance with a preferred embodiment of the present invention.

Also, while not all elements may be labeled in each FIGURE, all elements with the same reference number indicate similar or identical parts.

DETAILED DESCRIPTION OF THE PREFERRED EMBODIMENTS

The present invention relates generally to an electrolytic cell comprising nickel anodes, copper electrical connections, a rectifier and a cooled cathode, which functions to increase the pH of the nickel bath and replenish nickel in the nickel bath by dissolution of the nickel anode.

In one embodiment, the present invention relates generally to an electrolytic cell 10 for adjusting pH and replenishing nickel in a nickel plating solution, the electrolytic cell 10 comprising:

a) an inlet 12 for receiving nickel plating solution from a nickel plating bath;
b) a cooled cathode 14 connected to a first bus bar 44, said first bus bar connected to a negative terminal of a power supply 40;
c) a plurality of nickel anodes 16 capable of creating hydrogen gas on the cooled cathode 14 when current is applied, connected to at least a second bus bar 42, said at least the second bus bar 42 connected to a positive terminal of the power supply 40; and
d) an outlet 18 for returning nickel plating solution in the electrolytic cell 10 to the nickel plating bath.

As discussed above, each of the nickel anodes 16 is connected to at least a second bus bar 42 that is connected to a positive terminal of a power supply 40. In addition, at least one cathode 14 is connected to a first bus bar 44 that is connected to the negative terminal of power supply 40. The power supply 40 also includes a rectifier for converting alternating current to direct current and the flow of direct current between the positively charged nickel anodes 16 and negatively charged cathode 14 cause the nickel anode 16 to dissolve.

The electrolytic cell 10 is typically maintained at a temperature of between about 70° F. and about 150° F., more preferably between about 130° F. and about 140° F.

The plurality of nickel anodes 16 preferably comprise a plurality of nickel anode baskets so that the nickel plating solution is able to freely flow through the electrolytic cell 10.

The at least one cathode 14 is typically maintained at a temperature of less than about 100° F., more preferably less than about 90° F. and is preferably constructed of titanium, stainless steel, or steel. In a preferred embodiment, the at least one cathode 14 is cooled by providing at least one conduit 30 that contains chilled water to circulate the chilled water inside a cavity formed by the cathode 14 to cool the cathode 14. The cathode 14 may also be cooled by connecting the cathode to a water-cooled bus bar 44, wherein chilled water passes through the length of bus bar 44. Preferably, the cooled cathode 14 comprises an inner cavity through which cooling water is circulated.

In addition, the cathode 14 preferably has applied to it a current density of greater than about 150 asf, more preferably a current density of greater than about 250 asf.

In another embodiment, the present invention relates generally to a method of adjusting the pH and nickel content of a nickel plating solution, the method comprising the steps of:

a) diverting a portion of the nickel plating solution from a nickel plating bath to an electrolytic cell, said electrolytic cell comprising a cooled cathode and a plurality of nickel anodes capable of creating hydrogen gas on the cooled cathode when current is applied;
b) applying current to the nickel anode and the cooled cathode for a period of time to increase the pH of the nickel plating solution in the electrolytic cell, wherein the electrolytic cell replenishes nickel by dissolution of the nickel anode; and
c) returning the nickel plating solution in the electrolytic cell to the nickel plating bath.

The electrolytic cell 10 described herein is 95-100% efficient in dissolving nickel and less than 5% efficient in plating nickel. The cathode reaction is primarily the reduction of hydrogen ions to hydrogen gas.

$$Ni^{0} \rightarrow Ni^{+2} + 2e^{-} \text{ Anode reaction}$$

$$H^{+} 2e^{-} \rightarrow H_2T \text{ Cathode reaction}$$

The electrolytic cell 10 replaces hydrogen ions with nickel ions which causes the pH and nickel concentration to increase. Nickel metal will plate out of a typical nickel plating bath with 90-95% efficiency. In contrast, the electrolytic cell described herein reduces the cathode efficiency for plating nickel to less than 5% by purposefully altering the current density and temperature of the cathode.

In a preferred embodiment, a cathode current density of greater than 150 amp/ft$^2$ in combination with a cathode temperature of less than 100° F. essentially eliminates nickel plating at the cathode. More preferably, it is desired that the cathode current density be greater than 250 amp/ft$^2$ and the cathode temperature be less than 90° F.

Thus, while the prior art controlled the pH of the nickel plating bath by the addition of nickel carbonate or lithium carbonate to the bath, the present invention instead uses an electrolytic cell to control pH and replenish nickel and can be sized based on the amount of pH adjustment that is needed. For example, in a preferred embodiment, the electrolytic cell has an electrical capacity of 400 amps, which can typically adjust the pH of the nickel plating solution similar to the addition of one pound per hour of lithium carbonate and one pound per hour of nickel metal.

While various nickel plating solutions can be treated using the method described herein, in one embodiment, the nickel plating solution comprises a semi-bright nickel plating solution. The nickel plating solution may comprise a nickel sulfamate plating solution although other plating solutions are also known to those skilled in the art and would be usable with the present invention.

In addition, while the present invention has been described with regards to electrolytic plating, it is also contemplated that the present invention is applicable with the adjustment of electroless plating solutions as well.

The invention will now be described in accordance with the following non-limiting example:

EXAMPLE 1

A plating cell was set up with an inert anode plating a steel cathode to demonstrate nickel plating and an electrolytic cell was set up with a nickel anode creating hydrogen gas on a cooled cathode to demonstrate the electrolytic cell of the present invention.

A semi-bright nickel plating bath was tested comprising 50 oz/gal of nickel sulfamate, 5 oz/gal of boric acid and a starting of 4.0.

| Time | pH | Inert Anode | Cathode | Temperature of Solution (° F.) |
|---|---|---|---|---|
| 9.50 | 4.13 | 21.0 amps, 13 v | 20.5 amps, 13.7 v | 140 |
| 10.20 | 3.8 | | | |

Thus, it can be seen that the pH decreased from 4.13 to 3.8 in 30 minutes.

The inert anode was then turned off and the nickel anode was run with the cooled cathode in accordance with the process of the present invention.

| Time | pH | Inert Anode Cooling Water 75° F. | Nickel Anode with Cooled Cathode | Temperature (° F.) |
|---|---|---|---|---|
| 10.22 | 3.8 | n/a | 23.5 amps, 14.4 v | 140 |
| 10.28 | 4.63 | | | |

Running the electrolytic cell six minutes with the cooled cathode increased the pH from 3.8 to 4.61. The cathode had a surface area of 7 $in^2$, and there was no plating on the titanium cathode. Increasing the cathode area to 15 $in^2$ caused plating to occur on the cathode and hindered the increase of pH. As discussed above, the cathode should have a current density of greater than 150 amp/$ft^2$ in combination with a cathode temperature of less than 100° F. to prevent plating.

It should also be understood that the following claims are intended to cover all of the generic and specific features of the invention described herein and all statements of the scope of the invention that as a matter of language might fall there between.

What is claimed is:

1. An electrolytic cell for adjusting pH and replenishing nickel in a nickel plating solution, the electrolytic cell comprising:

a) an inlet for receiving nickel plating solution from a nickel plating bath;

b) a cooled cathode connected to a first bus bar, said first bus bar connected to a negative terminal of a power supply;

c) a plurality of nickel anodes capable of creating hydrogen gas on the cooled cathode when current is applied, connected to at least a second bus bar, said at least the second bus bar connected to a positive terminal of the power supply; and d) an outlet for returning nickel plating solution in the electrolytic cell to the nickel plating bath;

wherein the cooled cathode comprises at least one conduit for chilled water, wherein the at least one conduit circulates the chilled water within the cathode to cool the cathode.

2. The electrolytic cell according to claim 1, wherein the plurality of nickel anodes comprise a plurality of nickel anode baskets.

3. The electrolytic cell according to claim 1, wherein the cooled cathode comprises titanium.

4. The electrolytic cell according to claim 1, wherein the nickel plating solution in the electrolytic cell is maintained at a temperature of between about 70° F and about 150° F.

5. The electrolytic cell according to claim 4, wherein the nickel plating solution in the electrolytic cell is maintained at a temperature of between about 130° F and about 140° F.

6. The electrolytic cell according to claim 1, wherein the cathode is maintained at a temperature of less than 100° F.

7. The electrolytic cell according to claim 6, wherein the cathode is maintained at a temperature of less than 90° F.

8. The electrolytic cell according to claim 1, wherein a current density of greater than about 150 asf is applied to the cathode.

9. The electrolytic cell according to claim 8, wherein a current density of greater than about 250 asf is applied to the cathode.

10. A method of adjusting the pH and nickel content of a nickel plating solution, the method comprising the steps of: a) diverting a portion of the nickel plating solution from a nickel plating bath to an electrolytic cell, said electrolytic cell comprising a cooled cathode and a plurality of nickel anodes capable of creating hydrogen gas on the cooled cathode when current is applied, wherein the cooled cathode comprises at least one conduit for chilled water, wherein the at least one conduit circulates the chilled water within the cathode to cool the cathode; b) applying current to the nickel anode and the cooled cathode for a period of time to increase the pH of the nickel plating solution in the electrolytic cell, wherein the electrolytic cell replenishes nickel by dissolution of the nickel anode; and c) returning the nickel plating solution in the electrolytic cell to the nickel plating bath.

11. The method according to claim 10, wherein the nickel plating solution in the electrolytic cell is maintained at a temperature of between about 70° F. and about 150° F.

12. The method according to claim 11, wherein the nickel plating solution in the electrolytic cell is maintained at a temperature of between about 130° F and about 140° F.

13. The method according to claim 10, wherein the cathode is maintained at a temperature of less than 100° F.

14. The method according to claim 13, wherein the cathode is maintained at a temperature of less than 90° F.

15. The method according to claim 13, wherein the cathode is cooled by circulating chilled water inside the cathode.

16. The method according to claim 15, wherein the chilled water is at a temperature of less than about 100° F.

17. The method according to claim 10, wherein a current density of greater than about 150 asf is applied to the cathode.

18. The method according to claim 17, wherein a current density of greater than about 250 asf is applied to the cathode.

19. The method according to claim 10, wherein the cathode efficiency for plating nickel in the electrolytic cell is less than 5%.

20. The method according to claim 10, wherein the electrolytic cell is about 95 to about 100% efficient in dissolving nickel.

21. The method according to claim 10, wherein the nickel plating solution comprises a semi-bright or bright nickel plating solution.

22. The method according to claim 21, wherein the nickel plating solution comprises a nickel sulfamate plating solution.

23. An electrolytic cell for adjusting pH and replenishing nickel in a nickel plating solution, the electrolytic cell comprising:

a) an inlet for receiving nickel plating solution from a nickel plating bath;

b) a cooled cathode connected to a first bus bar, said first bus bar connected to a negative terminal of a power supply;

c) a plurality of nickel anodes capable of creating hydrogen gas on the cooled cathode when current is applied, connected to at least a second bus bar, said at least the second bus bar connected to a positive terminal of the power supply; and d) an outlet for returning nickel plating solution in the electrolytic cell to the nickel plating bath;

wherein chilled water is capable of passing through the length of the first bus bar, wherein the first bus bar and the cathode connected to the first busbar are cooled.

* * * * *